US010927637B2

(12) United States Patent
Cheng et al.

(10) Patent No.: US 10,927,637 B2
(45) Date of Patent: Feb. 23, 2021

(54) SYSTEM AND METHOD FOR REDUCING SETTING LOADS

(71) Applicant: Vetco Gray, LLC, Houston, TX (US)

(72) Inventors: Samuel Heung Yeung Cheng, Katy, TX (US); Wei He, Houston, TX (US); Andrew Ingram, Houston, TX (US); Kevin O'Dell, Houston, TX (US); Gregory Dunn, Houston, TX (US)

(73) Assignee: Vetco Gray, LLC, Houston, TX (US)

( * ) Notice: Subject to any disclaimer, the term of this patent is extended or adjusted under 35 U.S.C. 154(b) by 63 days.

(21) Appl. No.: 16/205,897

(22) Filed: Nov. 30, 2018

(65) Prior Publication Data

US 2020/0173247 A1 Jun. 4, 2020

(51) Int. Cl.
*E21B 33/128* (2006.01)

(52) U.S. Cl.
CPC ..... *E21B 33/1285* (2013.01)

(58) Field of Classification Search
CPC ..... E21B 33/02; E21B 33/10; E21B 33/128; E21B 33/1208; E21B 33/1285
See application file for complete search history.

(56) References Cited

U.S. PATENT DOCUMENTS 4,131,287 A 12/1978 Gunderson
4,641,708 A * 2/1987 Wightman ..... E21B 33/043 166/208
4,702,481 A 10/1987 Brammer
4,790,572 A 12/1988 Slyker
5,060,724 A * 10/1991 Brammer ..... E21B 33/03 166/208
5,129,660 A 7/1992 Taylor et al.
5,456,314 A * 10/1995 Boehm, Jr. ..... E21B 33/04 166/208
5,735,344 A 4/1998 Duncan
8,561,995 B2 10/2013 Thomson
10,001,216 B2 6/2018 Puccio
2003/0226668 A1 12/2003 Zimmerman et al.
2007/0164565 A1 7/2007 Evans et al.
2011/0180275 A1 7/2011 Shaw
2012/0012336 A1* 1/2012 Galle ..... E21B 33/04 166/379
2013/0248199 A1* 9/2013 Gette ..... E21B 33/035 166/368
2014/0069646 A1* 3/2014 Barnhart ..... E21B 33/03 166/285
2015/0101830 A1 4/2015 Sommerfeld et al.

OTHER PUBLICATIONS

"Drilling & Production Systems Surface Wellhead & Tree Technology Update," General Electric, 2009, 25 pages.
International Search Report and Written Opinion dated Feb. 10, 2020 in International Application No. PCT/US19/62966.

* cited by examiner

*Primary Examiner* — David Carroll
(74) *Attorney, Agent, or Firm* — Hogan Lovells US LLP

(57) ABSTRACT

Embodiments include an energizing ring for setting a downhole seal includes a body having a varied cross-section along at least a portion of an axial length. The energizing ring also includes a plurality of peaks forming at least a portion of the varied cross-section having a first diameter. The energizing ring also includes a plurality of valleys forming at least a portion of the varied cross-section having a second diameter, the first diameter being larger than the second diameter, and respective valleys of the plurality of valleys being arranged proximate respective peaks of the plurality of peaks.

19 Claims, 7 Drawing Sheets

SYSTEM AND METHOD FOR REDUCING SETTING LOADS

BACKGROUND

1. Field of the Invention

This disclosure relates in general to oil and gas tools, and in particular, to systems and methods for sealing between components in wellbore operations.

2. Description of Related Art

In oil and gas production, different pieces of equipment may be utilized in a downhole environment in order to isolate sections of a wellbore. For example, casing may be installed along an outer circumferential extent of the wellbore and additional equipment, such as hangers and the like, may be installed within the wellbore. The hanger may be used to support wellbore tubulars utilized within the system. In operation, seals (e.g., elastomeric, metal, etc.) may be arranged between the downhole components in order to establish pressure barriers in order to direct fluid into and out of the well along predetermined flow paths. Seals may be "U" shaped and energized via an energizing ring that is driven into the U-opening to provide pressure to drive the seals against the wellbore components. The energizing ring is typically driven into position using setting tools that rely on bore pressure, which may be limited due to other equipment used at the site, such as blowout preventers (BOPs).

SUMMARY

Applicant recognized the limitations with existing systems herein and conceived and developed embodiments of systems and methods, according to the present disclosure, to improve the systems by reducing setting loads for downhole sealing systems.

In an embodiment, an energizing ring for setting a downhole seal includes a body having a varied cross-section along at least a portion of an axial length. The energizing ring also includes a plurality of peaks forming at least a portion of the varied cross-section having a first diameter. The energizing ring also includes a plurality of valleys forming at least a portion of the varied cross-section having a second diameter, the first diameter being larger than the second diameter, and respective valleys of the plurality of valleys being arranged proximate respective peaks of the plurality of peaks.

In an embodiment, a system for forming a seal between downhole components includes a seal arranged between at least two downhole components. The seal includes a first leg and a second leg, each leg positioned proximate one of the at least two downhole components, wherein the first and second legs engage the at least two downhole components upon activation of the seal. The system also includes an energizing ring to activate the seal. The energizing ring extends into an opening of the seal to drive the first leg and the second leg radially outward relative to an axis of the energizing ring. The energizing ring includes a plurality of geometric features, forming a varied cross-section, that sequentially contact the seal when the energizing ring is installed within the opening, wherein respective geometric features of the plurality of geometric features form areas of high and low concentrations of pressure that alternate axially along a length of the energizing ring when installed within the opening.

In an embodiment, a method for setting a downhole seal includes arranging a seal within a wellbore between at least two wellbore components. The method also includes aligning an energizing ring with an opening of the seal. The method further includes driving the energizing ring into the opening of the seal to deform the seal. The method includes engaging legs of the seal with a plurality of geometric features formed on the energizing ring, the geometric features reducing a contact area between the legs and the energizing ring.

BRIEF DESCRIPTION OF DRAWINGS

The present technology will be better understood on reading the following detailed description of non-limiting embodiments thereof, and on examining the accompanying drawings, in which.

DETAILED DESCRIPTION

Figure 1:
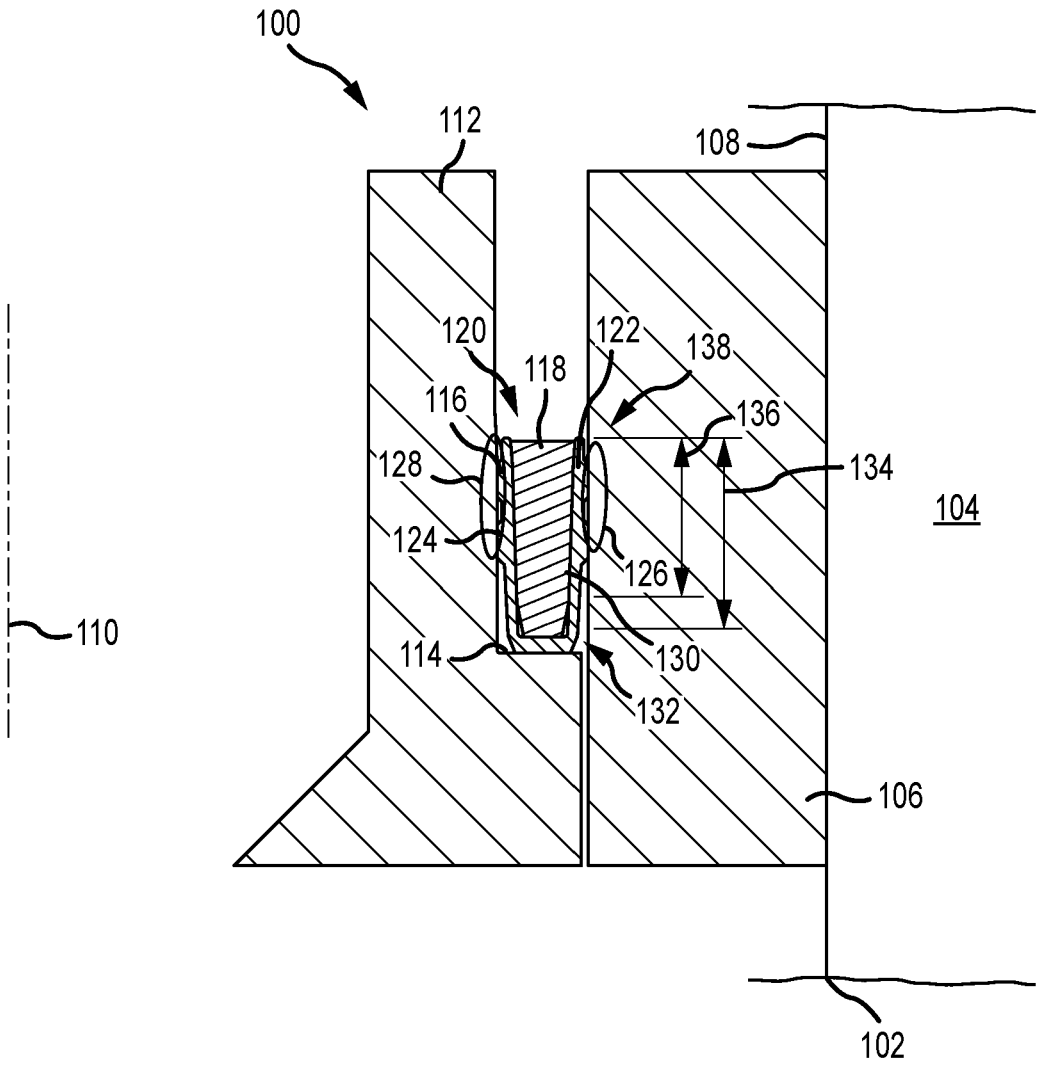
FIG. 1 is a cross-sectional side view of an embodiment of an energizing ring setting a seal, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Mechanically energized U-cup type metal annular pack offs are set by forcing an actuating energizing ring into the inside of a U-cup sealing element. The energizing ring expands the sealing element into the seal pocket and provides mechanical preload into the sealing surfaces. This mechanical preload provides the contact pressure for containing pressure. The setting load is a function of two components: 1) the friction between the energizing ring and the U-cup seal interfaces, and 2) the energy to provide compression preload on the sealing surface. The compression load is designed to provide a predetermined amount of contact pressure to form a metal-to-metal seal. Accordingly, it is not desirable to lower the compression load so that the setting load can be optimized.

Embodiments of the present disclosure lower the frictional load between the energizing ring and the sealing element via a series of geometrical features. In various embodiments, the geometric features may include a set of bumps, a set of tapers and flats, or a combination thereof. As a result of small contact areas between the interface, the setting load is reduced. In other words, setting loads are decreased as the radial clamping force or frictional load that the energizing ring applies to the sealing element is reduced at valleys or pockets formed between the geometric features. Moreover, in various embodiments, less strain energy is transmitted to the sealing element because there is less expansion at certain areas. Accordingly, the setting load may be reduced because of a reduction in friction load. However, this reduction in friction load may be caused by a reduction in energy to expand the seal because the non-contact points between the geometric features may lead to less energy to expand the seal. That is, less energy to expand the seal may correspond to a lower radial load, which may further correspond to less normal load. This normal load may be correlated to friction. Therefore, in embodiments, the reduction in energy to expand the seal may also correspond to a reduced frictional load. Furthermore, in various embodiments, local increases in mechanical advantage may further reduce the loads. As the energizing ring enters the sealing element, the first set of geometrical features (e.g., bumps/tapers) contacts the sealing element. This causes the sealing element to expand. As the energizing ring is driven further into the sealing element, each bump/taper in the series sequentially makes contact and preloads the sealing element. The bumps/tapers may be sized such that only the crest (e.g., highest part) maintains contact with the sealing element. This reduction in contact area reduces the overall frictional loads due to the reduced radial contact loads, as described above. In other words, the geometrical features form localized points of interference, rather than a continuous interface along a length of the energizing ring. Moreover, it should be appreciated that while embodiments of the present disclosure may include a plurality of geometric features, in various embodiments, a single geometric feature may be utilized. In various embodiments, lubricious coatings may further be integrated in order to enhance the frictional reduction.

In various embodiments, setting a mechanically energized metal seal uses large settings loads. As described above, these loads are the result of the friction between the energizing ring and the sealing element, as well as the preload to form a seal. In the operational case, where the seal is run with a tool that uses bore pressure, the maximum pushing capacity may be limited by a blowout preventer (BOP) or other wellhead components. For example, the annular/pipe rams of the BOP are closed and the annular void between the tool and the BOP is pressurized. This pressure applies a piston force to the tool, which sets the seal. If the seal is set in a lower pressure rated wellhead, and the BOP is downsized for cost, it is possible that the annular tool pressure may not be sufficient to set the seal. Embodiments of the present disclosure reduce the setting load of the seal without compromising the sealing capability. As a result, the seal can be set in more scenarios, and the tools can be downsized. Furthermore, in various embodiments, reducing the setting load may enable design of tools with more contact pressure to provide enhanced sealing capabilities using existing setting equipment.

FIG. 1 is a cross-sectional side view of an embodiment of a wellbore sealing system 100 arranged within a borehole 102 extending into a downhole formation 104. It should be appreciated that, for clarity with the discussion herein, various components of a well site that may include the borehole 102 have been eliminated. For example, the well site may include surface equipment, such as drilling rigs, wellhead components, and the like. In the illustrated embodiment, a housing 106 is arranged against a borehole wall 108 and radially outward with respect to a borehole axis 110. It should be appreciated that the borehole 102, housing 106, and various other components may be annular components that extend about the borehole axis 110. Furthermore, in various embodiments, the housing 106 may be a casing that is cemented to the borehole wall 108. Additionally, in embodiments, the hanger 112 may be arranged at an uphole location, for example within a wellhead, and may include one or more test ports that may extend into the space between the hanger 112 and the housing 106 to test the integrity of the seal, among other things.

In the illustrated embodiment, a hanger 112 is arranged radially inward from the housing 106 and includes a shoulder 114 that receives the wellbore sealing system 100. The illustrated hanger 112 may receive one or more wellbore tubulars that are suspended into the borehole 102, for example, to recover hydrocarbons. The wellbore sealing system 100 illustrated in FIG. 1 includes a seal 116 that is a U-shaped cup. In operation, the seal 116 receives an energizing ring 118 within an opening 120 that drives legs 122, 124 of the seal 116 radially outward such that a seal is formed between the hanger 112 and the housing 106. In various embodiments, the seal is formed from an elastomer, metal, composite material, or the like. However, for clarity with the present discussion, the seal 116 will be described as a metallic seal that forms a metal-to-metal seal between the hanger 112 and the housing 106.

As described above, the energizing ring 118 is driven into the opening 120 via the setting load, which is a combination of a frictional force between the energizing ring 118 and the seal 116 and an energy to provide compression preload at sealing surfaces 126, 128. In the illustrated embodiment, the energizing ring 118 has a substantially straight edge 130 and a lower tapered portion 132. The substantially straight edge 130 occupies a majority of a length 134 of the energizing ring 118, and as a result, a length 136 of the substantially straight edge 130 may be referred to as a point of interference 138. It should be appreciated that the point of interference 138 may be used to describe a contact area and does not necessarily refer to a singular point or singular location. That is, the point of interference 138 may be used to refer to an extended surface or as an interface between the energizing ring 118 and the seal 116. Because the point of interference 138 is substantially the length 134 of the energizing ring 118, the point of interference may be substantially equal to a total contact area where frictional forces between the energizing ring 118 and the seal 116 may be high. In other words, as the energizing ring 118 is installed, the point of interference is maintained along the length of the energizing ring 118 throughout installation. As a result, a larger force is used to drive the energizing ring 118 into the opening 120. That is, the larger frictional force, along with a pre-determined desired compression preload, leads to a larger setting load. As will be described herein, embodiments of the present disclosure utilize one or more geometric features to reduce the point of interference, thereby reducing frictional forces and reducing the setting load.

Figure 2:
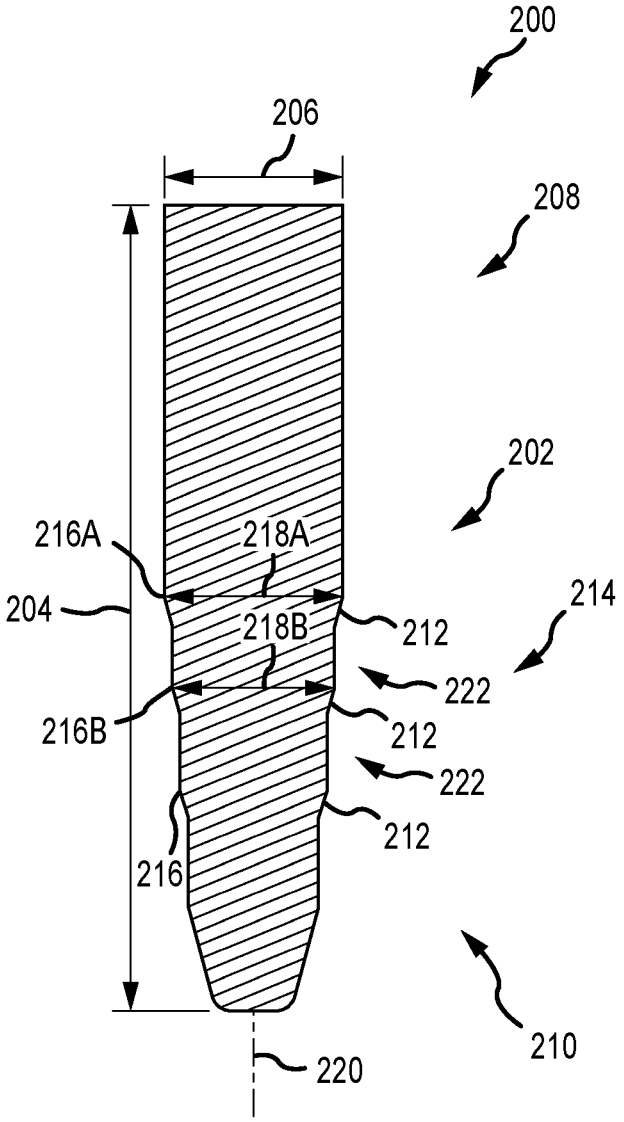
FIG. 2 is a cross-sectional side view of an embodiment of an energizing ring, in accordance with embodiments of the present disclosure.

FIG. 2 is a cross-sectional view of an embodiment of an energizing ring 200. The illustrated energizing ring 200 includes geometrical features 202 that are utilized to decrease the point of interference (e.g., contact area) between the energizing ring 200 and the seal. As shown, the energizing ring 200 has a length 204 and a first width 206 of a substantially straight portion 208. A lower portion 210 of the energizing ring 200 includes a plurality of tapers 212 to form a stepped region 214 having a plurality of peaks or crests 216. In the illustrated embodiment, the peak 216 has a larger diameter than an axially lower peak 216. That is, a first peak 216A has a larger diameter 218A than a diameter 218B of a second peak 216B. In the illustrated embodiment, the energizing ring 200 is symmetrical relative to an axis 220. The stepped region 214 may further be described as forming valleys 222 between the peaks 216. The illustrated alternating peaks 216 and valleys 222 form the energizing ring 200 having a varied cross-section along at least a portion of the axial length 204. As a result, the outer surface of the energizing ring 200, which engages the seal, includes the illustrated peaks 216 and valleys 222. As a result, when the energizing ring 200 is installed within the seal 114, the points of interference may be isolated to the peaks 216, thereby forming a smaller overall contact area when compared to the energizing ring 118 illustrated in FIG. 1. Accordingly, the frictional forces associated with the energizing ring 200 may be reduced, while still maintaining the desired pre-determined compression preload. Moreover, in embodiments, coatings and/or lubrication may also be incorporated with the energizing ring 200 to further reduce frictional loads. As a result, the setting load for installing the energizing ring 200 may be reduced.

Figure 3:
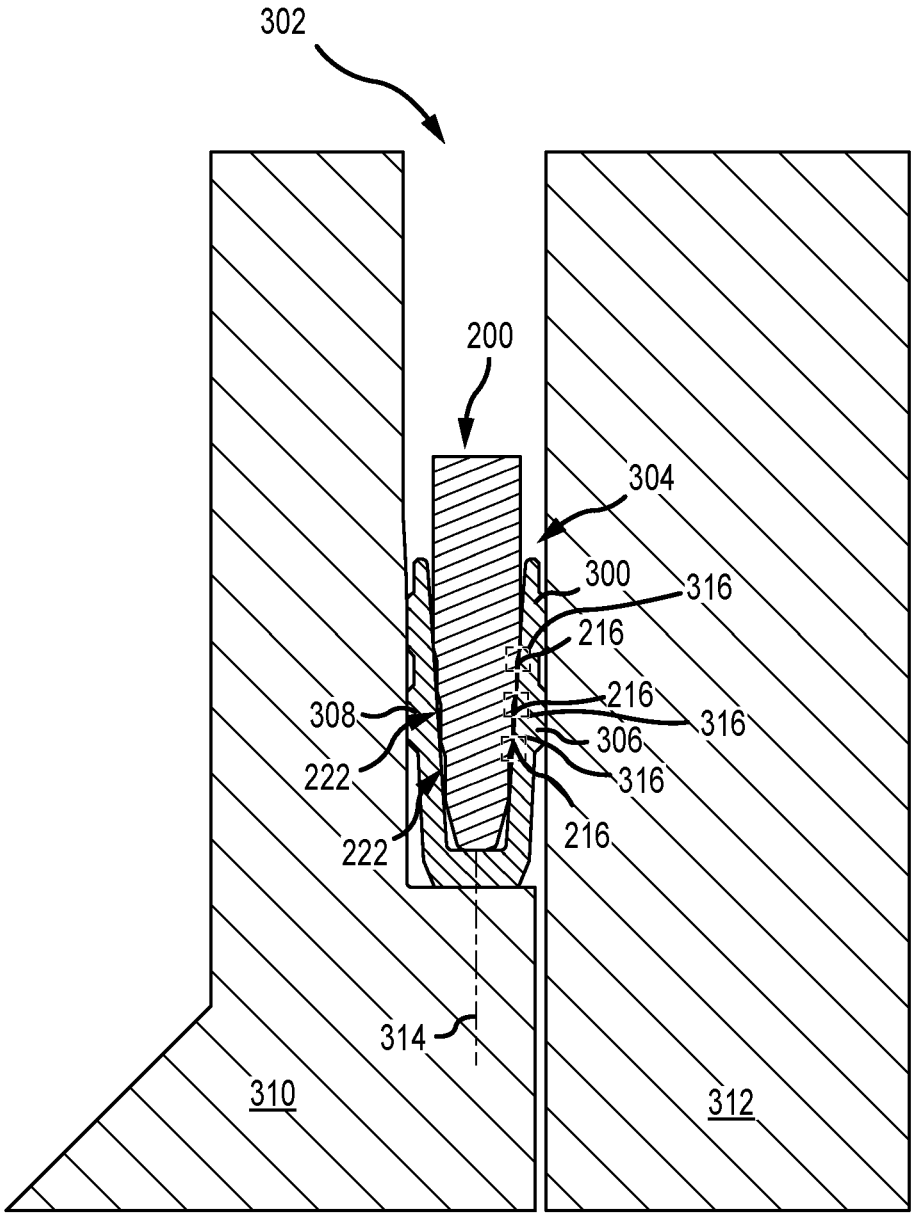
FIG. 3 is a cross-sectional view of an embodiment of the energizing ring of FIG. 2 setting a seal, in accordance with embodiments of the present disclosure.

FIG. 3 is a cross-sectional view of an embodiment of the energizing ring 200 arranged within a seal 300 of a wellbore sealing system 302. In the illustrated embodiment, the energizing ring 200 extends into an opening 304 between the legs 306, 308 of the U-shaped seal 300, thereby driving the legs 306, 308 radially outward, with respect to an axis 314, to form a metal-to-metal seal between a hanger 310 and housing 312.

As shown, the legs 306, 308 are deformed by the energizing ring 200 such that they move radially outward from the axis 314 of the energizing ring 200. The radially outward force is applied by the peaks 216 that contact the legs 306, 308. In the illustrated embodiment, the valleys 222 are not in contact with the legs 306, 308. As a result, a point of interference 316 at each peak 216 is only formed at the peak or crest and does not include the full lower portion 210 of the energizing ring 200. That is, as the energizing ring 200 is installed within the seal 300, the points of interference 316 formed along a length of the opening 304 may be limited to the areas at the peaks 216. In other words, the varied cross section creates areas of high and low concentrations of pressure alternating axially when installed within the opening of the seal. As a result, a total contact area, which may be equal to the sum of each point of interference 316, is smaller than the contact area of the embodiment illustrated in FIG. 1. Accordingly, the setting load may be reduced due to a reduction of the frictional force, as described above. However, the reduction in the setting load does not reduce the compression preload, and as a result, the seal 300 is still set between the hanger 310 and the housing 312. It should be appreciated that the lower setting loads may enable using wellbore components and wellhead components having lower pressure ratings, which are typically less expensive than components with higher pressure ratings. As a result, costs may be reduced for operators.

Figure 4:
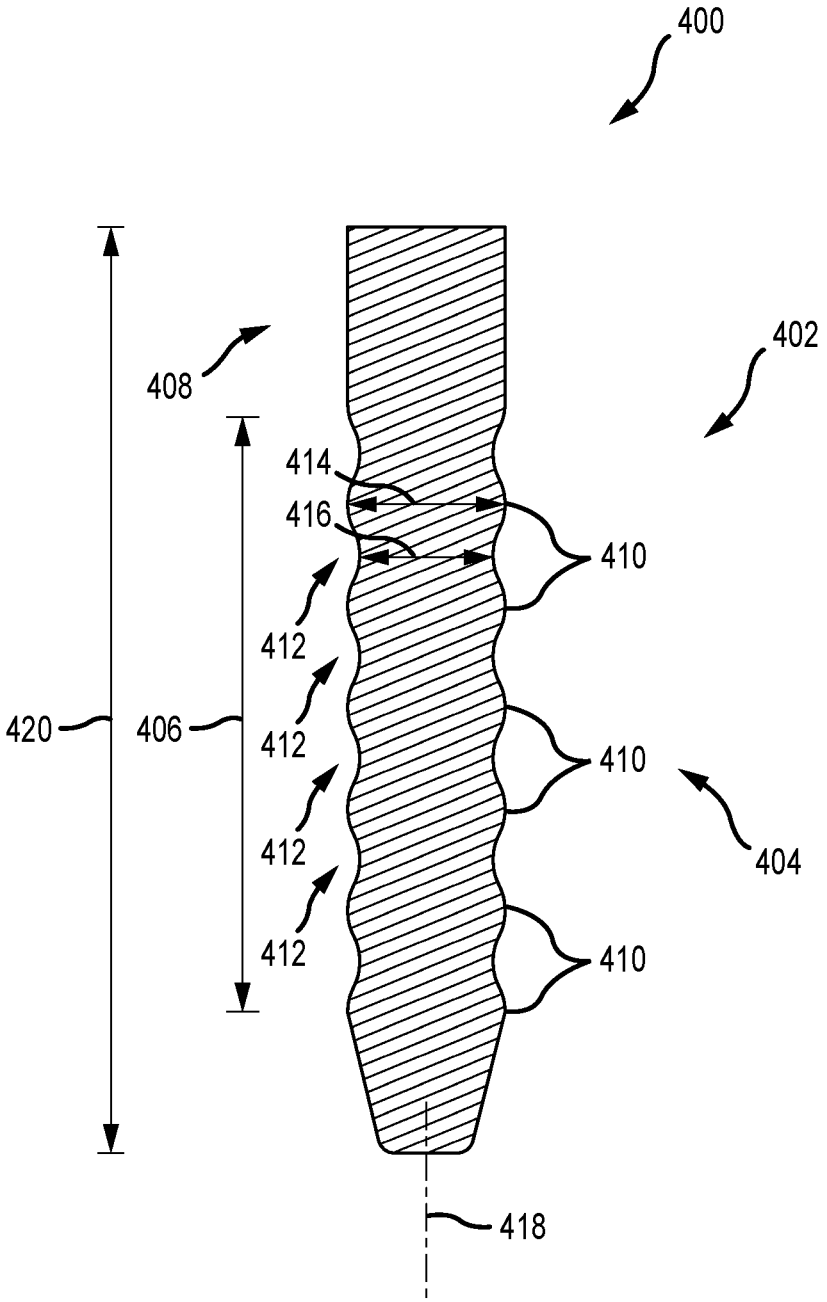
FIG. 4 is a cross-sectional side view of an embodiment of an energizing ring, in accordance with embodiments of the present disclosure.

FIG. 4 is a cross-sectional view of an embodiment of an energizing ring 400 having a plurality of geometrical features 402. In the illustrated embodiment, the geometrical features 402 may be referred to as waves, bumps, or a sinusoidal pattern extending along a lower portion 404 of the energizing ring 400. This illustrated wavy region 406 of the lower portion 404 may be distinguished from the substantially straight upper portion 408 of the energizing ring 400. In the illustrated embodiment, the waves of the wavy region 406 form peaks or crests 410 and valleys 412 between the peaks or crests 410. A diameter 414 of the peaks 410 is larger than a diameter 416 of the valleys 412. In the illustrated embodiment, the energizing ring 400 is symmetrical relative to an axis 418, and as a result, the respective peaks 410 and valleys 412 are symmetrically located. As will be described below, the valleys 412 may not contact the seal when the energizing ring 400 is installed, thereby reducing the contact area by decreasing the point of interference along a length 420 of the energizing ring 400. Moreover, in embodiments, coatings and/or lubrication may also be incorporated with the energizing ring 400 to further reduce frictional loads.

Figure 5:
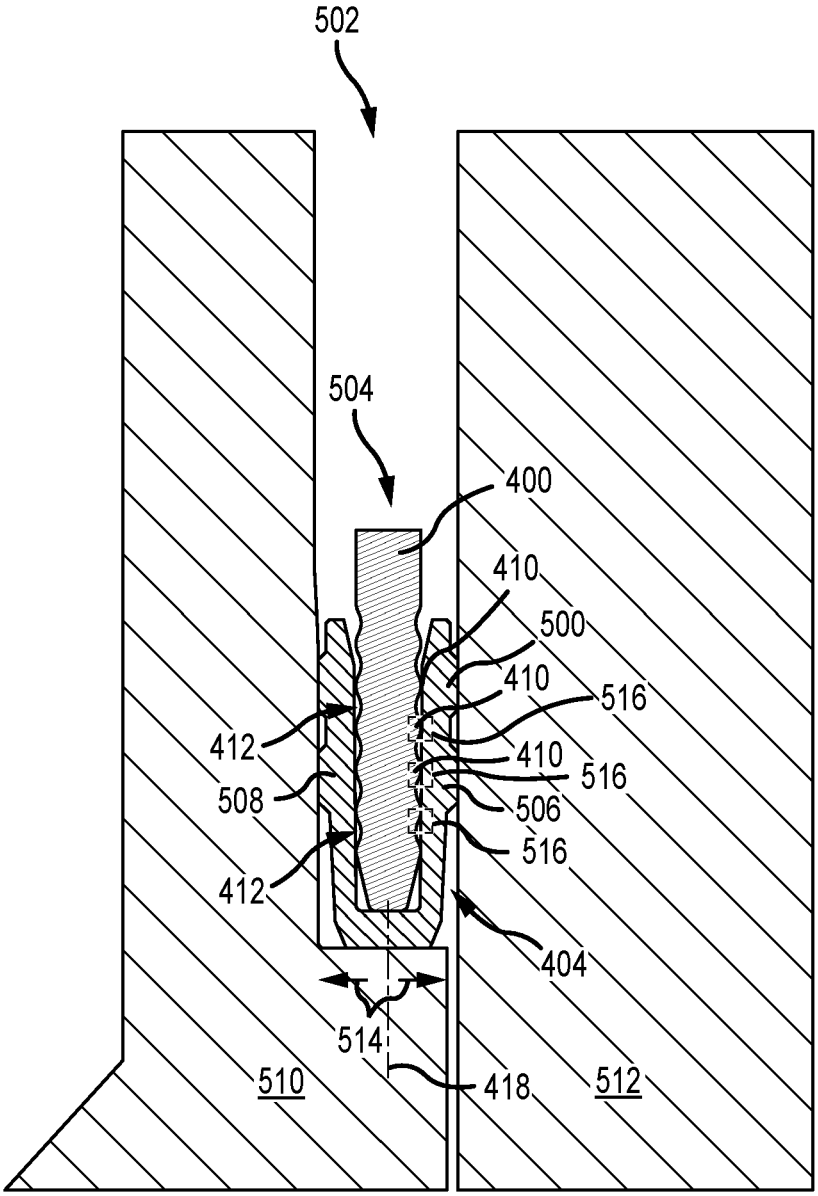
FIG. 5 is a cross-sectional view of an embodiment of the energizing ring of FIG. 4 setting a seal, in accordance with embodiments of the present disclosure.

FIG. 5 is a cross-sectional view of an embodiment of the energizing ring 400 arranged within a seal 500 of a wellbore sealing system 502. In the illustrated embodiment, the energizing ring 400 extends into an opening 504 between the legs 506, 508 of the U-shaped seal 500, thereby driving the legs 506, 508 radially outward from the axis 418 to form a metal-to-metal seal between a hanger 510 and housing 512.

As shown, the legs 506, 508 are deformed by the energizing ring 400 such that they move radially outward from the axis 418 of the energizing ring 400. The radially outward force 514 is applied by the peaks 410 that contact the legs 506, 508. In the illustrated embodiment, the valleys 412 are not in contact with the legs 506, 508. As a result, a point of interference 516 at each peak 410 is only formed at the peak or crest and does not include the full lower portion 404 of the energizing ring 400. That is, as the energizing ring 400 is installed within the seal 400, the points of interference 516 formed along a length of the opening 504 may be limited to the areas at the peaks 410. As a result, a total contact area, which may be equal to the sum of each point of interference 516, is smaller than the contact area of the embodiment illustrated in FIG. 1. Accordingly, the setting load may be reduced due to a reduction of the frictional force, which is a function of the contact area. However, the reduction in the setting load does not significantly reduce the compression preload, and as a result, the seal 500 is still set between the hanger 510 and the housing 512. In other words, if there is a reduction in the compression preload it may be significantly less than the reduction in the setting force. It should be appreciated that the lower setting loads may enable using wellbore components and wellhead components having lower pressure ratings, which are typically less expensive than components with higher pressure ratings. As a result, costs may be reduced for operators.

Figure 6:
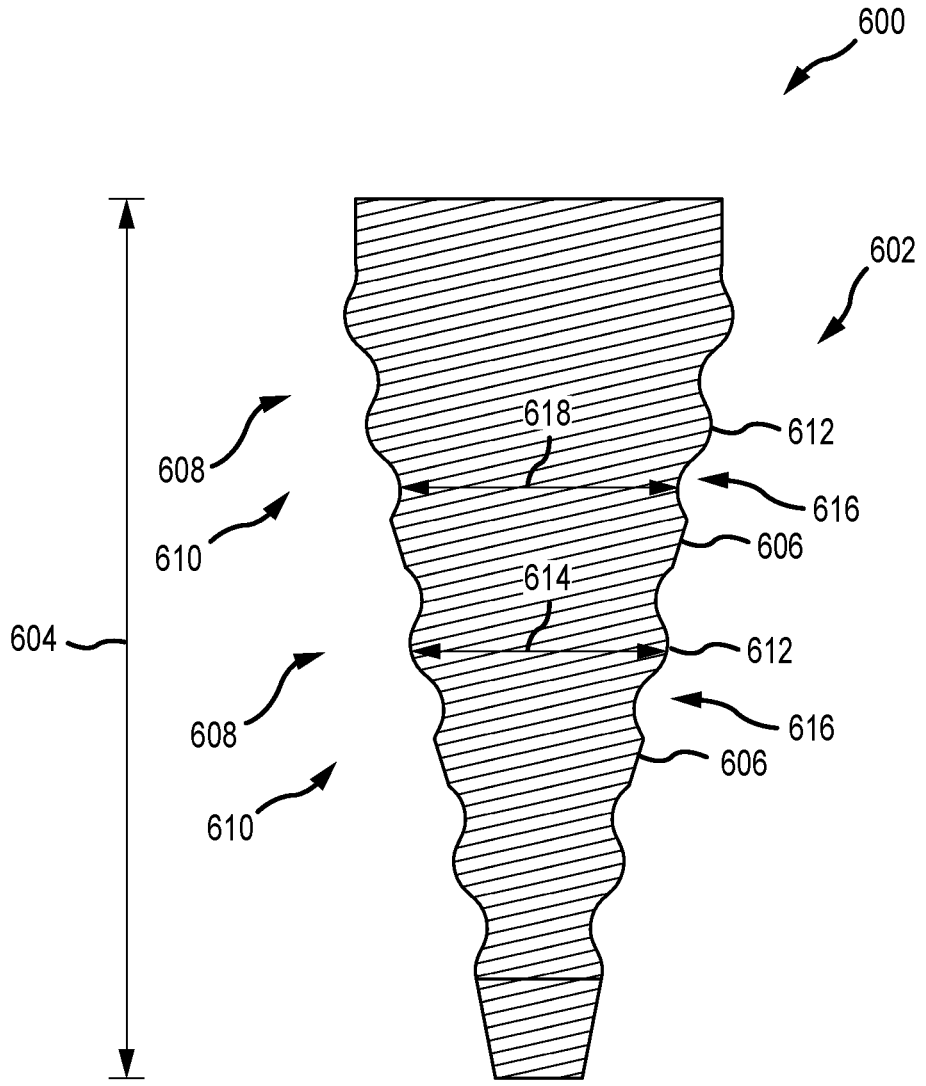
FIG. 6 is a cross-sectional side view of an embodiment of an energizing ring, in accordance with embodiments of the present disclosure.

FIG. 6 is a cross-sectional view of an embodiment of an energizing ring 600 having a plurality of geometrical features 602. It should be appreciated that the embodiment illustrated in FIG. 6 incorporates certain features from both the energizing ring 200 and the energizing ring 400. Accordingly, in various embodiments, different geometrical features may be mixed to form various peaks and valleys to enable a reduced contact area between the energizing ring and the seal. In the illustrated embodiment, the geometrical features 602 extend along at least a portion of a length 604 of the energizing ring 600 and include both tapers 606 and waves or a sinusoidal pattern 608. In the illustrated embodiment, the tapers 606 are arranged between wavy sections 610, thereby reducing the diameter of the energizing rings at those sections. However, in the embodiment illustrated in FIG. 6, each peak or crest 612 within the respective wavy sections 610 have a substantially equal diameter 614. Furthermore, each valley 616 within the respective wavy sections 610 has a substantially equal diameter 618, which is smaller than the diameter 614 of the peaks. As described above, the valleys 616 may not contact the seal when the energizing ring 600 is installed, thereby reducing the contact area by decreasing the points of interference along the energizing ring 600.

Figure 7:
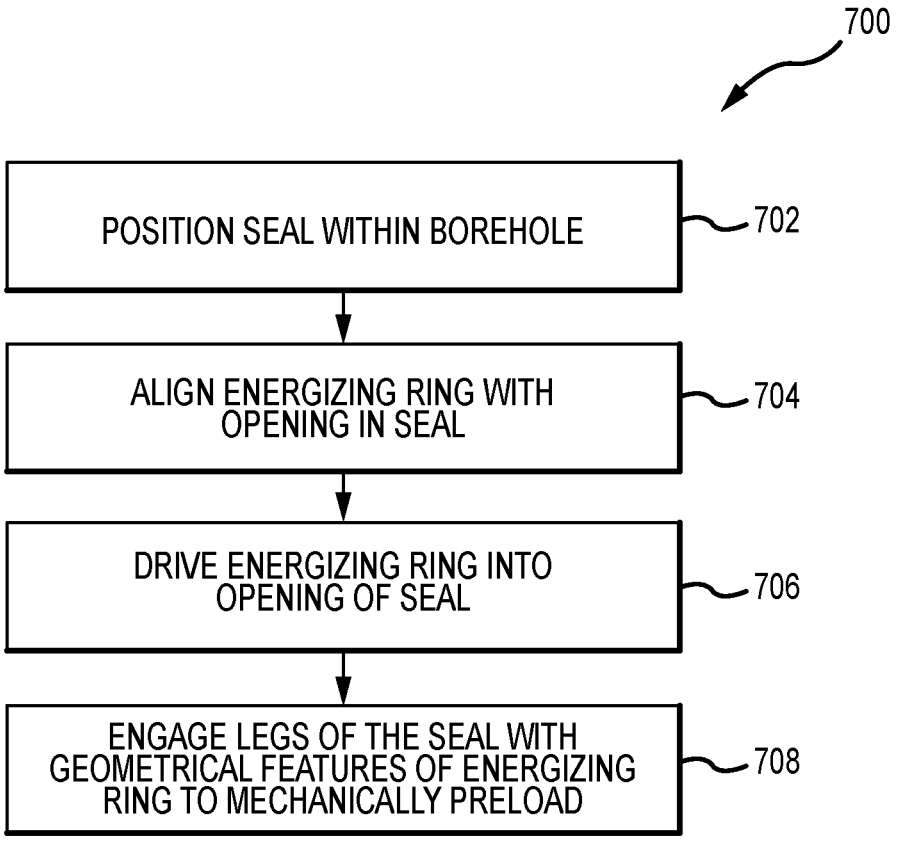
FIG. 7 is a flow chart of an embodiment of a method for setting a seal, in accordance with embodiments of the present disclosure.

FIG. 7 is a flow chart of an embodiment of a method 700 for mechanically preloading a seal. It should be appreciated for this method, and any methods described herein, that the steps may be performed in any order or in parallel, unless otherwise specifically stated. Moreover, the method 700 may include more, fewer, or alternative steps. In this example, a seal is arranged within a borehole (block 702). For example, in various embodiments, the seal 116, 300, 500 may be arranged on the shoulder 114 of the hanger 112, 310, 510. As described above, the seal 116, 300, 500 may be utilized to block a flow of fluid between the hanger 112, 310, 510 and the housing 106, 312, 512. An energizing ring is aligned with an opening in the seal (block 704). For example, the energizing ring 200, 400, 600 may be positioned proximate the opening 304, 504. As described above, the energizing ring 200, 400, 600 may include one or more geometric features 202, 402, 602 to drive the seal 116, 300, 500 into sealing contact between the hanger 112, 310, 510 and the housing 106, 312, 512. In various embodiments, the energizing ring is driven into the opening of the seal (block 706). For example, in embodiments including the BOP, the BOP may be closed and wellbore pressure may be used to apply a force to the energizing ring 200, 400, 600 that drives the energizing ring 200, 400, 600 in a downward direction and into the opening 304, 504. Moreover, in embodiments, a setting tool may be used. In embodiments, the energizing ring engages legs of the seal with the geometrical features to mechanically preload the seal (block 708). For example, as illustrated in FIGS. 3 and 5, the energizing ring 200, 400 includes the respective geometric features 202, 402 that drive the legs 306, 308, 506, 508 radially outward to seal against the hanger 112, 310, 510 and the housing 106, 312, 512. In various embodiments, the geometric features 202, 402 include peaks 216, 410, 612 that engage the legs 306, 308, 506, 508 while respective valleys 222, 412, 616 do not engage the legs 306, 308, 506, 508. As described above, such an arrangement reduces a contact area between the energizing ring 200, 400, 600 and the seal 116, 300, 500. That is, individual points of interference 316, 516 are formed at the respective peaks 216, 410, 612 to reduce frictional forces when compared to embodiments where larger portions of energizing rings contact the seal. Accordingly, the setting load is reduced due to the reduction of the frictional forces. As described above, reducing the setting load enables wellbore components with lower pressure ratings to be used, which are often cheaper, thereby reducing costs for operators.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. An energizing ring for setting a downhole seal, comprising:

a body having a varied cross-section along at least a portion of an axial length, the varied cross-section being symmetrical about an axis of the body;

a plurality of peaks forming at least a portion of the varied cross-section having a first diameter, each peak of the plurality of peaks being at the first diameter; and a plurality of valleys forming at least a portion of the varied cross-section having a second diameter, each valley of the plurality of valleys being at the second diameter, the first diameter being larger than the second diameter, and respective valleys of the plurality of valleys being arranged proximate respective peaks of the plurality of peaks.

2. The energizing ring of claim 1, wherein the respective valleys of the plurality of valleys are arranged between pairs of peaks of the plurality of peaks.

3. The energizing ring of claim 1, wherein a peak of the plurality of peaks is formed by a tapered section extending radially inward toward an axis of the energizing ring.

4. The energizing ring of claim 1, wherein a peak of the plurality of peaks is formed by a bump having a curved edge.

5. The energizing ring of claim 1, wherein the energizing ring is arranged within an opening of a seal, the energizing ring being positioned within the seal such that a peak of the plurality of peaks is in contact with the seal and a valley of the plurality of valleys is not in contact with the seal.

6. The energizing ring of claim 5, wherein contact between the peak and the seal forms a point of interference, the point of interference corresponding to a location where a frictional force between the energizing ring and the seal opposes movement of the energizing ring in a first direction, opposite a second direction of a setting load.

7. A system for forming a seal between downhole components, the system comprising:

a seal arranged between at least two downhole components, the seal comprising a first leg and a second leg, each leg positioned proximate one of the at least two downhole components, wherein the first and second legs engage the at least two downhole components upon activation of the seal;

an energizing ring to activate the seal, the energizing ring extending into an opening of the seal to drive the first leg and the second leg radially outward relative to an axis of the energizing ring, the energizing ring comprising a plurality of geometric features, forming a varied cross-section, that sequentially contact the seal when the energizing ring is installed within the opening, wherein respective geometric features of the plurality of geometric features form areas of high and low concentrations of pressure that alternate axially along a length of the energizing ring when installed within the opening;

a setting tool for driving the energizing ring into the opening of the seal; and a pressure control device for directing a wellbore pressure toward the energizing ring to drive the energizing ring into the opening of the seal;

wherein the wellbore pressure is configured to exceed a setting pressure to enable the energizing ring to apply a compression preload to the seal and to overcome frictional forces between the seal and the energizing ring.

8. The system of claim 7, wherein the plurality of geometric features comprise bumps, flats, tapers, or a combination thereof.

9. The system of claim 7, wherein the plurality of geometric features comprises a sequential line of bumps arranged along at least a portion of the energizing ring.

10. The system of claim 7, wherein the plurality of geometric features form a plurality of crests at a first diameter and a plurality of valleys at a second diameter, wherein the first diameter is larger than the second diameter.

11. The system of claim 7, wherein the plurality of geometric features comprise a first taper extending radially inward to a first diameter, a first flat extending axially at the first diameter, and a second taper extending radially inward to a second diameter, the second diameter being less than the first diameter.

12. The system of claim 11, wherein the first flat includes a plurality of bumps, the bumps forming peaks at a third diameter and valleys, arranged between the peaks, at the first diameter, the third diameter being larger than the first diameter.

13. The system of claim 7, wherein the frictional forces between the seal and the energizing ring are a function of a contact area between the geometric features and the seal.

14. The system of claim 7, wherein the compression preload is a pre-determined value.

15. The system of claim 7, wherein the seal and the energizing ring are both made from a metal.

16. The system of claim 7, wherein the energizing ring plastically deforms the seal when the energizing ring activates the seal.

17. A method for setting a downhole seal, comprising:

arranging a seal within a wellbore between at least two wellbore components;

aligning an energizing ring with an opening of the seal;

driving the energizing ring into the opening of the seal to deform the seal; and engaging legs of the seal with a plurality of geometric features formed symmetrically on the energizing ring, the geometric features having alternating first and second diameters, the first diameters contacting the seal as the energizing ring transitions into the opening, reducing a contact area between the legs and the energizing ring.

18. The method of claim 17, wherein the energizing ring is driven into the opening of the seal via wellbore pressure.

19. The method of claim 17, wherein the geometric features comprise a plurality of peaks and valleys, the peaks being at the first diameter and the valleys being at the second diameter, the method further comprising:

sequentially contacting the legs with only the peaks as the energizing ring is driven into the opening of the seal; and maintaining a space between the valleys and the legs.

* * * * *